US011200851B2

(12) United States Patent
Yamanaka

(10) Patent No.: US 11,200,851 B2
(45) Date of Patent: Dec. 14, 2021

(54) DISPLAY DEVICE AND METHOD FOR DRIVING SAME

(71) Applicant: SHARP KABUSHIKI KAISHA, Sakai (JP)

(72) Inventor: Shigetsugu Yamanaka, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/264,644

(22) PCT Filed: Sep. 7, 2018

(86) PCT No.: PCT/JP2018/033134
§ 371 (c)(1),
(2) Date: Jan. 29, 2021

(87) PCT Pub. No.: WO2020/049707
PCT Pub. Date: Mar. 12, 2020

(65) Prior Publication Data

US 2021/0319757 A1 Oct. 14, 2021

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/0278* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 2008/0042937 | A1 | 2/2008 | Shikina | |
| 2010/0156945 | A1 | 6/2010 | Yoshida | |
| 2015/0211707 | A1 | 7/2015 | Watanabe | |
| 2017/0352328 | A1 | 12/2017 | Jeong et al. | |
| 2018/0158404 | A1 | 6/2018 | Li | |
| 2019/0206363 | A1* | 7/2019 | Yang | G09G 5/10 |

FOREIGN PATENT DOCUMENTS

| | | | |
|---|---|---|---|
| JP | 2005-049822 | A | 2/2005 |
| JP | 2008-009280 | A | 1/2008 |
| JP | 2017-227880 | A | 12/2017 |
| WO | 2008/062575 | A1 | 5/2008 |
| WO | 2014/010463 | A1 | 1/2014 |

* cited by examiner

*Primary Examiner* — Nitin Patel
*Assistant Examiner* — Amen W Bogale
(74) *Attorney, Agent, or Firm* — ScienBiziP, P.C.

(57) ABSTRACT

In a display device having a non-rectangular display panel, when the display panel is divided into a rectangular region and a non-rectangular region by a boundary line extending in a same direction as scanning lines, light emission control lines are driven so that a length of a first non-light emission period in which pixel circuits in each row in the rectangular region are in a non-light emission state and a length of a second non-light emission period in which the pixel circuits in each row in the non-rectangular region are in the non-light emission state are different. With this, a luminance difference that occurs near a boundary between the rectangular region and the non-rectangular region is suppressed, and display quality is improved.

15 Claims, 13 Drawing Sheets

DISPLAY DEVICE AND METHOD FOR DRIVING SAME

TECHNICAL FIELD

The disclosure relates to a display device, and more particularly to a display device having a non-rectangular display panel and a method for driving the same.

BACKGROUND ART

An organic electro-luminescence (hereinafter referred to as EL) display device is used in various electronic devices such as a television and a smartphone. A rectangular organic EL panel is used in the organic EL display device used for the television or the like. On the other hand, in the organic EL display device used for the smartphone or the like, a non-rectangular organic EL panel may be used in order to improve design and operability.

Related to the disclosure, Patent Documents 1 and 2 each describe a display device having a non-rectangular display panel. Patent Document 3 describes a display device having a control means for decreasing a length of a light emission period from a central region to a peripheral region.

RELATED ART DOCUMENTS

Patent Documents

[Patent Document 1] international Publication No. WO2008/62575

[Patent Document 2] International Publication No. WO2014/10463

[Patent Document 3] Japanese Patent Publication No. 2008-9280

SUMMARY

Problems to be Solved

An organic EL panel 90 shown in FIG. 18 is a non-rectangular display panel having four round corners 91 to 94 and a notch 95. Scanning lines (not shown) extend horizontally in the drawing, and pixel circuits (not shown) are arranged two-dimensionally. The organic EL panel 90 is divided into a rectangular region RB and non-rectangular regions RA, RC by two boundary lines extending in a same direction as the scanning lines.

A load of the scanning line in the non-rectangular regions RA, RC is smaller than the load of the scanning line in the rectangular regions RB. Thus, distortion of a signal on the scanning line in the non-rectangular regions RA, RC is smaller than the distortion of the signal on the scanning line in the rectangular region RB, and a charging rate when a voltage is written to the pixel circuit in the non-rectangular regions RA, RC is higher than the charging rate when the voltage is written to the pixel circuit in the rectangular region RB. Therefore, when a same voltage is provided to all the pixel circuits, luminance of the non-rectangular regions RA, RC becomes higher or lower than the luminance of the rectangular region RB. In general, when a luminance difference between adjacent regions is 1% or more of correct luminance, a human recognizes the luminance difference, and display quality deteriorates.

The above point becomes a problem not only in the organic EL display device having the non-rectangular organic panel, but also in a display device having a non-rectangular display panel in general. Note that the non-rectangular display panel is assumed to include not only a display panel having an outer peripheral shape other than a rectangle but also a rectangular display panel having an opening portion.

Therefore, providing a display device having a non-rectangular display panel and capable of suppressing a luminance difference that occurs near a boundary between a rectangular region and a non-rectangular region is taken as a problem.

Means for Solving the Problems

The above problem can be solved by a display device having a non-rectangular display panel including a plurality of scanning lines, a plurality of data lines, a plurality of light emission control lines extending in a same direction as the scanning lines, and a plurality of pixel circuits; a scanning line drive circuit configured to drive the scanning lines to select the pixel circuits in units of row; a data line drive circuit configured to drive the data lines; and a light emission cortisol line drive circuit configured to drive the light emission control lines to control the pixel circuits to a light emission state and a non-light emission state in units of row, and when the display panel is divided into a rectangular region and a non-rectangular region by a boundary line extending in the same direction as the scanning lines, the light emission control line drive circuit is configured to drive the light emission control lines so that a length of a first non-light emission period in which the pixel circuits in each row in the rectangular region are in the non-light emission state and a length of a second non-light emission period in which the pixel circuits in each row in the non-rectangular region are in the non-light emission state are different.

The above problem can also be solved by a method for driving a display device having a non-rectangular display panel including a plurality of scanning lines, a plurality of data lines, a plurality of light emission control lines extending in a same direction as the scanning lines, and a plurality of pixel circuits, the method includes driving the scanning lines to select the pixel circuits in units of row; driving the data lines; and driving the light emission control lines to control the pixel circuits to a light emission state and a non-light emission state in units of row, and when the display panel is divided into a rectangular region and a non-rectangular region by a boundary line extending in the same direction as the scanning lines, in driving the light emission control lines, the light emission control lines are driven so that a length of a first non-light emission period in which the pixel circuits in each row in the rectangular region are in the non-light emission state and a length of a second non-light emission period in which the pixel circuits in each row in the non-rectangular region are in the non-light emission state are different.

Effects

According to the above display device and method for driving the same, in the display device having the non-rectangular display panel, by suitably setting the length of the first non-light emission period (non-light emission period of the pixel circuits in each row in the rectangular region) and the length of the second non-light emission period (non-light emission period of the pixel circuits in each row in the non-rectangular region), a luminance difference that occurs near a boundary between the rectangular region and the non-rectangular region can be suppressed, and display quality can be improved.

DESCRIPTION OF THE EMBODIMENTS

Figure 1:
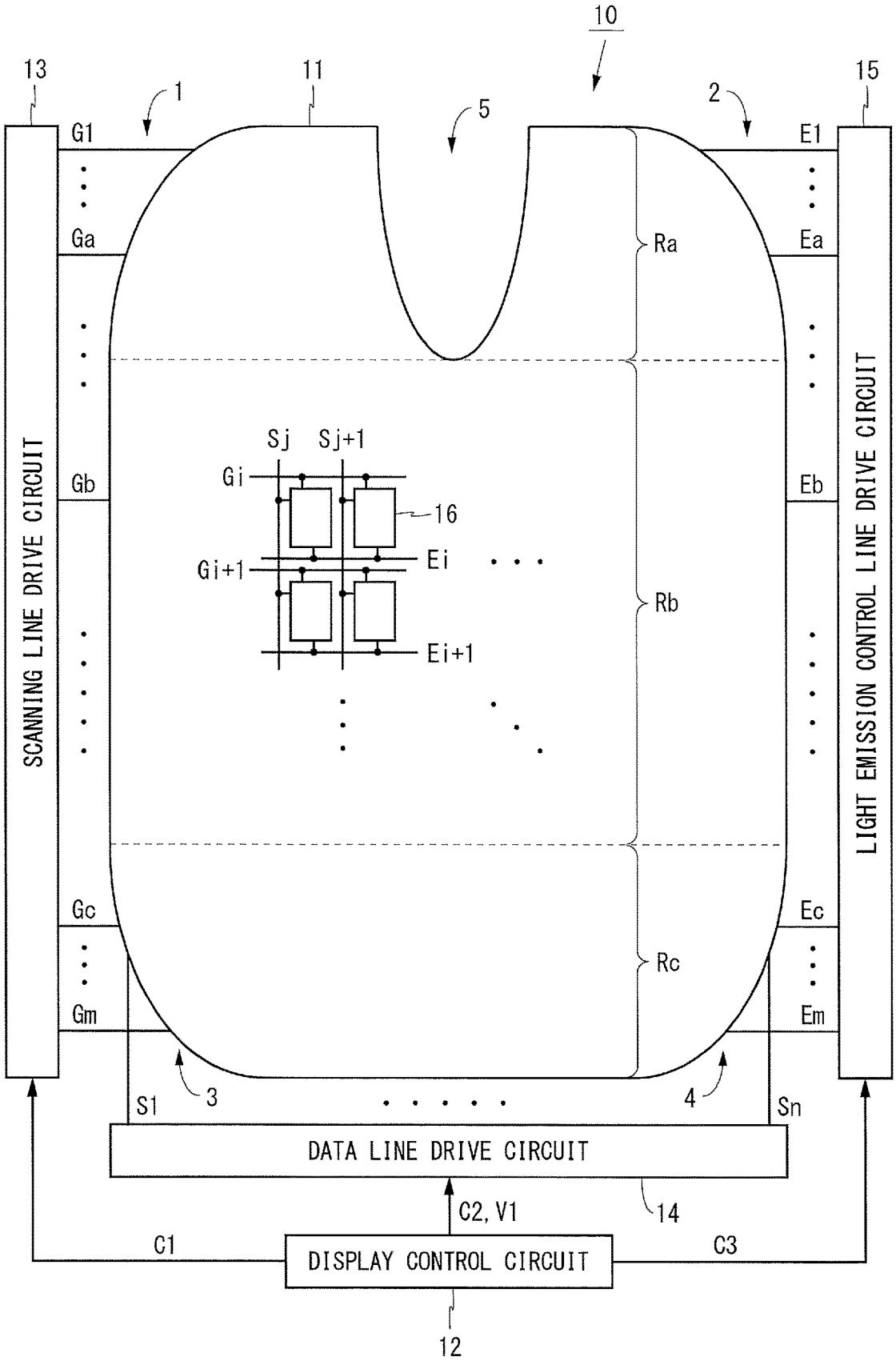
FIG. 1 is a block diagram showing a configuration of an organic EL display device according to an embodiment.

FIG. 1 is a block diagram showing a configuration of an organic EL display device according to an embodiment. An organic EL display device 10 shown in FIG. 1 includes an organic EL panel 11, a display control circuit 12, a scanning line drive circuit 13, a data line drive circuit 14, and a light emission control line drive circuit 15. Hereinafter, a horizontal direction of the drawings is referred to as a row direction, and a vertical direction of the drawings is referred to as a column direction. Furthermore, it is assumed that m and n are integers not less than 2, i is an integer not less than 1 and not more than m, and j is an integer not less than 1 and not more than n.

The organic EL panel 11 is a non-rectangular display panel having four round corners 1 to 4 and a notch 5. The organic EL panel 11 includes m scanning lines G1 to Gm, m light emission control lines E1 to Em, n data lines S1 to Sn, and a plurality of pixel circuits 16. The scanning lines G1 to Gm extend in the row direction and are arranged in parallel to each other. The light emission control lines E1 to Em extend in the row direction (same direction as the scanning lines G1 to Gm) and are arranged in parallel to each other. The scanning lines G1 to Gm, and the light emission control lines E1 to Em extend with detouring around the notch 5 at a necessary position. The data lines S1 to Sn extend in the column direction and are arranged in parallel to each other. The scanning lines G1 to Gm and the data lines S1 to Sn intersect perpendicularly.

The plurality of pixel circuits 16 is arranged near intersections of the scanning lines G1 to Gm and the data lines S1 to Sn. Not more than n pixel circuits 16 are arranged in each row. The pixel circuit 16 includes an organic EL element and a plurality of thin film transistors (hereinafter referred to as TFTs) (none of them are shown). The organic EL element is a kind of electro-optical elements and functions as a light emitting element. The pixel circuit 16 is connected to one or more corresponding scanning line(s), one or more corresponding light emission control line(s), and a corresponding data line. As the pixel circuit 16, used is an arbitrary pixel circuit capable of controlling the organic EL element to a light emission state and a non-light emission state by using the light emission control line. Note that the scanning lines, the light emission control lines, the data lines, and the pixel circuits are not provided at positions of the round corners 1 to 4 and the notch 5.

The display control circuit 12 outputs a control signal C1 to the scanning line drive circuit 13, outputs a control signal C2 and a video signal V1 to the data line drive circuit 14, and outputs a control signal C3 to the light emission control line drive circuit 15. The scanning line drive circuit 13 drives the scanning lines C1 to Gm based on the control signal C1. More specifically, in the organic EL display device 10, m horizontal periods are set in one frame period. In an i-th horizontal period, the scanning line drive circuit 13 applies a selection level voltage to a scanning line Gi and applies a non-selection level voltage to other scanning lines. With this, in the i-th horizontal period, the pixel circuits 16 in an i-th row (not more than n pixel circuits 16 arranged in the i-th row) are selected collectively. In this manner, the scanning line drive circuit 13 drives the scanning lines G1 to Gm to select the pixel circuits 16 in units of row.

The data line drive circuit 14 drives the data lines S1 to Sn based on the control signal C2 and the video signal V1. More specifically, in the i-th horizontal period, the data line drive circuit 14 applies, to the data lines S1 to Sn, n voltages (hereinafter, referred to as data voltages) in accordance with the video signal V1. With this, in the i-th horizontal period, the data voltages are written to the pixel circuits 16 in the i-th row.

The light emission control line drive circuit 15 drives the light emission control lines E1 to Em based on the control signal C3. More specifically, the light emission control line drive circuit 15 applies a light emission level voltage to a light emission control line Ei in a light emission period of the pixel circuits 16 in the i-th row, and applies a non-light emission level voltage to the light emission control line Ei in a non-light emission period of the pixel circuits 16 in the i-th row. The pixel circuits 16 in the i-th row emit light in the light emission period of the pixel circuits 16 in the i-th row, and does not emit light in the non-light emission period of the pixel circuits 16 in the i-th row. In this manner, the light emission control line drive circuit 15 drives the light emission control lines E1 to Em to control the pixel circuits 16 to the light emission state and the non-light emission state in units of row.

The organic EL panel 11 is divided into a non-rectangular region Ra having the round corners 1, 2 and the notch 5, a rectangular region Rb, and a non-rectangular region Rc having the round corners 3, 4 by two boundary lines extending in the same direction as the scanning lines G1 to Gm. In the following description, it is assumed that the pixel circuits 16 in an a-th row are in the non-rectangular region Ra, the pixel circuits 16 in a b-th row are in the rectangular region Rh, and the pixel circuits 16 in a c-th row are in the non-rectangular region Rc. Lengths of selection periods of the pixel circuits 16 in the regions Ra to Rc are all one horizontal period. On the other hand, lengths of the non-light emission periods of the pixel circuits 16 in the regions Ra to Rc are p horizontal periods, q horizontal periods, and r horizontal periods, respectively. However, p, q, and r are integers not less than 1 that satisfy $p \neq q$ and $g \neq r$. P and r may be same or different.

Figure 2:
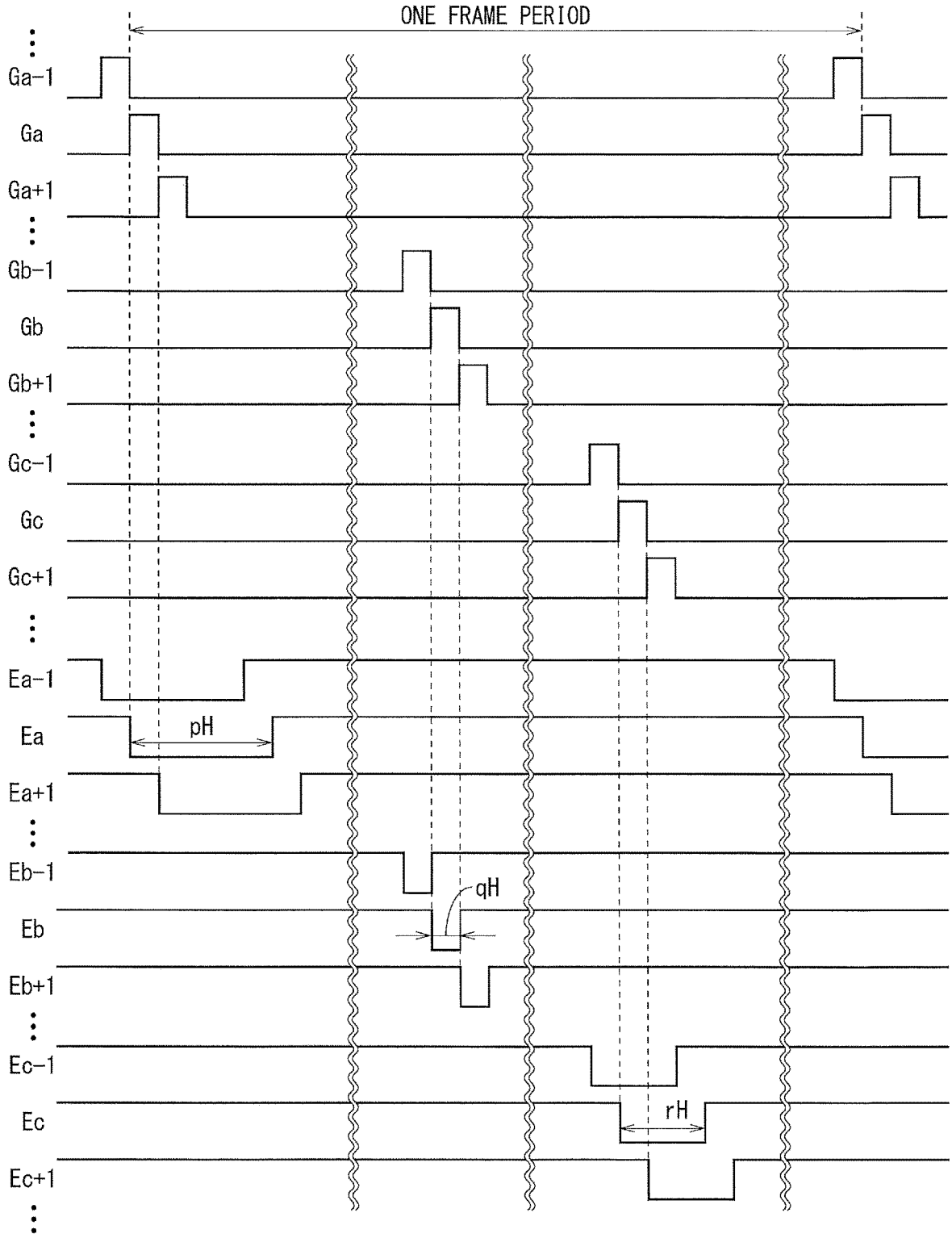
FIG. 2 is a timing chart of the organic EL display device shown in FIG. 1.

FIG. 2 is a timing chart of the organic EL display device 10. Here, a selection level and a light emission level are high levels, and a non-selection level and a non-light emission level are low levels. As shown in FIG. 2, a voltage of the scanning line Gi becomes the selection level in the i-th horizontal period, and becomes the non-selection level otherwise. A voltage of the light emission control line Ea becomes the non-light emission level in p horizontal periods including an a-th horizontal period, and becomes the light emission level otherwise. A voltage of the light emission control line Eb becomes the non-light emission level in p horizontal periods including a b-th horizontal period, and becomes the light emission level otherwise. A voltage of the light emission control line Ec becomes the non-light emission level in r horizontal periods including a c-th horizontal period, and becomes the light emission level otherwise.

In FIG. 2, lengths of the non-light emission periods of the pixel circuits 16 in each row in the rectangular region Rb are same. When setting is performed so that $p=r$, lengths of the non-light emission periods of the pixel circuits 16 in each row in the non-rectangular regions Ra, Rc are same. When setting is performed so that $p>q$ and $q<r$, the non-light emission periods of the pixel circuits 16 in each row in the non-rectangular regions Ra, Rc are longer than the non-light emission periods of the pixel circuits 16 in each row in the rectangular region Rb. When setting is performed so that $p<q$ and $p>r$, the non-light emission periods of the pixel circuits 16 in each row in the non-rectangular regions Ra, Rc are shorter than the non-light emission periods of the pixel circuits 16 in each row in the rectangular region Rb.

In FIG. 2, setting is performed so that $p=5$, $q=1$, and $r=3$. In this example, the voltage of the light emission control line Ea becomes the non-light emission level in a-th to (a+4)-th horizontal periods, and becomes the light emission level otherwise. The voltage of the light emission control line Eb becomes the non-light emission level in the b-th horizontal period, and becomes the light emission level otherwise. The voltage of the light emission control line Ec becomes the non-light emission level in c-th to (c+2)-th horizontal periods, and becomes the light emission level otherwise.

Hereinafter, a period from a start of the non-light emission period of the pixel circuit 16 in the rectangular region Rb to an end of the selection period of the same pixel circuit 16 is referred to as a first period, a period from a start of the non-light emission period of the pixel circuit 16 in the non-rectangular regions Ra, Rc to an end of the selection period of the same pixel circuit 16 is referred to as a second period, a period from the end of the selection period of the pixel circuit 16 in the rectangular region Rb to an end of the non-light emission period of the same pixel circuit 16 is referred to as a third period, and a period from the end of the selection period of the pixel circuit 16 in the non-rectangular regions Ra, Rc to an end of the non-light emission period of the same pixel circuit 16 is referred to as a fourth period.

In FIG. 2, with respect to the pixel circuits 16 in each row, the non-light emission period starts at a same timing as the selection period. With respect to the pixel circuits 16 in the a-th row, the non-light emission period ends at a timing four horizontal periods later than the selection period. With respect to the pixel circuits 16 in the b-th row, the non-light emission period ends at a same timing as the selection period. With respect to the pixel circuits 16 in the c-th row, the non-light emission period ends at a timing two horizontal periods later than the selection period. Therefore, the first period and the second period have a same length, and the fourth period is longer than the third period.

Values of p, q, and r are determined when designing the organic EL display device 10. When a same voltage is provided to all the pixel circuits 16 included in the organic EL panel 11 and the lengths of the non-light emission periods of all the pixel circuits 16 included in the organic EL panel 11 are set to be same, there are a case where luminance of the non-rectangular regions Ra, Rc is higher than the luminance of the rectangular region Rb, and a case where the luminance of the non-rectangular regions Ra, Rc is lower than the luminance of the rectangular region Rb. Hereinafter, the former is referred to as "when non-rectangular region has high luminance", and the latter is referred to as "when non-rectangular region has low luminance". Which of the cases occurs is determined by a configuration of the pixel circuit 16, a method for driving the organic EL panel 11, or the like.

When the non-rectangular region Ra has high luminance, the length of the non-light emission period of the pixel circuits 16 in the non-rectangular region Ra is determined so as to be longer than the length of the non light emission period of the pixel circuits 16 in the rectangular region Rb (so as to satisfy $p>q$). When the non-rectangular region Ra has low luminance, the length of the non-light emission period of the pixel circuits 16 in the non-rectangular region Ra is determined so as to be shorter than the length of the non-light emission period of the pixel circuits 16 in the rectangular region Rb (so as to satisfy $p<q$).

Similarly, when the non-rectangular region Rc has high luminance, the length of the non-light emission period of the pixel circuits 16 in the non-rectangular region Rc is determined so as to be longer than the length of the non-light emission period of the pixel circuits 16 in the rectangular region Rb (so as to satisfy $q<r$). When the non-rectangular region Rc has low luminance, the length of the non-light emission period of the pixel circuits 16 in the non-rectangular region Rc is determined so as to be shorter than the length of the non-light emission period of the pixel circuits 16 in the rectangular region Rb (so as to satisfy $q>r$).

In the organic EL display device 10, the length of the non-light emission period of the pixel circuits 16 in the non-rectangular regions Ra, Rc is determined so as to be different from the length of the non-light emission period of the pixel circuits 16 in the rectangular region Rb. The light emission control line drive circuit 15 drives the light emission control lines E1 to Em so that the length of the non-light emission period of the pixel circuits 16 in each row in the rectangular region Rb and the length of the non-light emission period of the pixel circuits 16 in each row in the non-rectangular regions Ra, Rc are different.

A luminance difference between the non-rectangular region Ra and the rectangular region Rb can be estimated based on a load difference between the scanning line Ga and the scanning line Gb. The luminance difference between the rectangular region Rb and the non-rectangular region Rc can be estimated based on the load difference between the scanning line Gb and the scanning line Gc. Therefore, by suitably determining the length of the non-light emission period of the pixel circuits 16 in each row in the rectangular region Rb and the length of the non-light emission period of the pixel circuits 16 in each row in the non-rectangular regions Ra, Rc based on the estimated luminance differences, the luminance difference that occurs near a boundary between the rectangular region Rb and the non-rectangular regions Ra, Rc can be suppressed, and display quality can be improved.

Hereinafter, as examples of the pixel circuit 16, pixel circuits with which the non-rectangular region has high luminance (first to fourth examples) and a pixel circuit with which the non-rectangular region has low luminance (fifth example) will be described.

Figure 3:
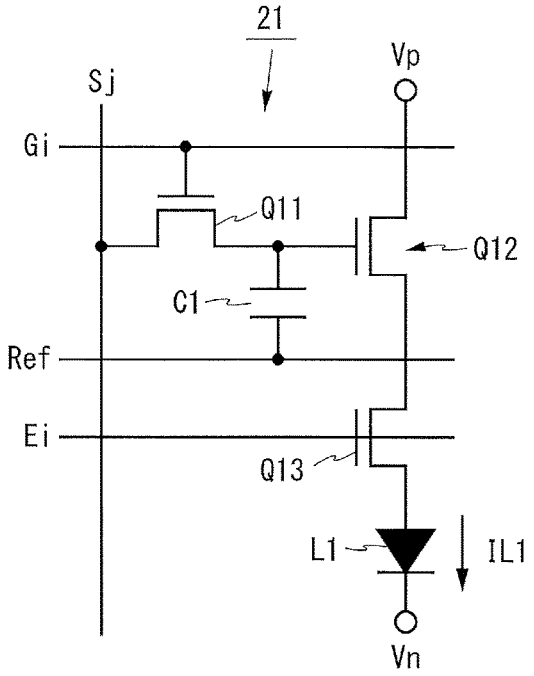
FIG. 3 is a circuit diagram of a pixel circuit according to a first example of the organic EL display device shown in FIG. 1.

FIG. 3 is a circuit diagram of a pixel circuit according to a first example. A pixel circuit 21 shown in FIG. 3 includes three N-channel type TFTs Q11 to Q13, a capacitor C1, and an organic EL element L1. One conduction terminal (left-side terminal in FIG. 3) of the TFT Q11 is connected to a data line Sj, the other conduction terminal of the TFT Q11 is connected to a gate terminal of the TFT Q12, and a gate terminal of the TFT Q11 is connected to the scanning line Gi. A high-level power supply voltage Vp is applied to a drain terminal of the TFT Q12, and a source terminal of the TFT Q12 is connected to a drain terminal of the TFT Q13. A source terminal of the TFT Q13 is connected to an anode terminal of the organic EL element L1, and a gate terminal of the TFT Q13 is connected to the light emission control line Ei. A low-level power supply voltage Vn is applied to a cathode terminal of the organic EL element L1. The capacitor C1 is provided between the gate terminal of the TFT Q12 and a reference voltage line Ref.

Figure 4:
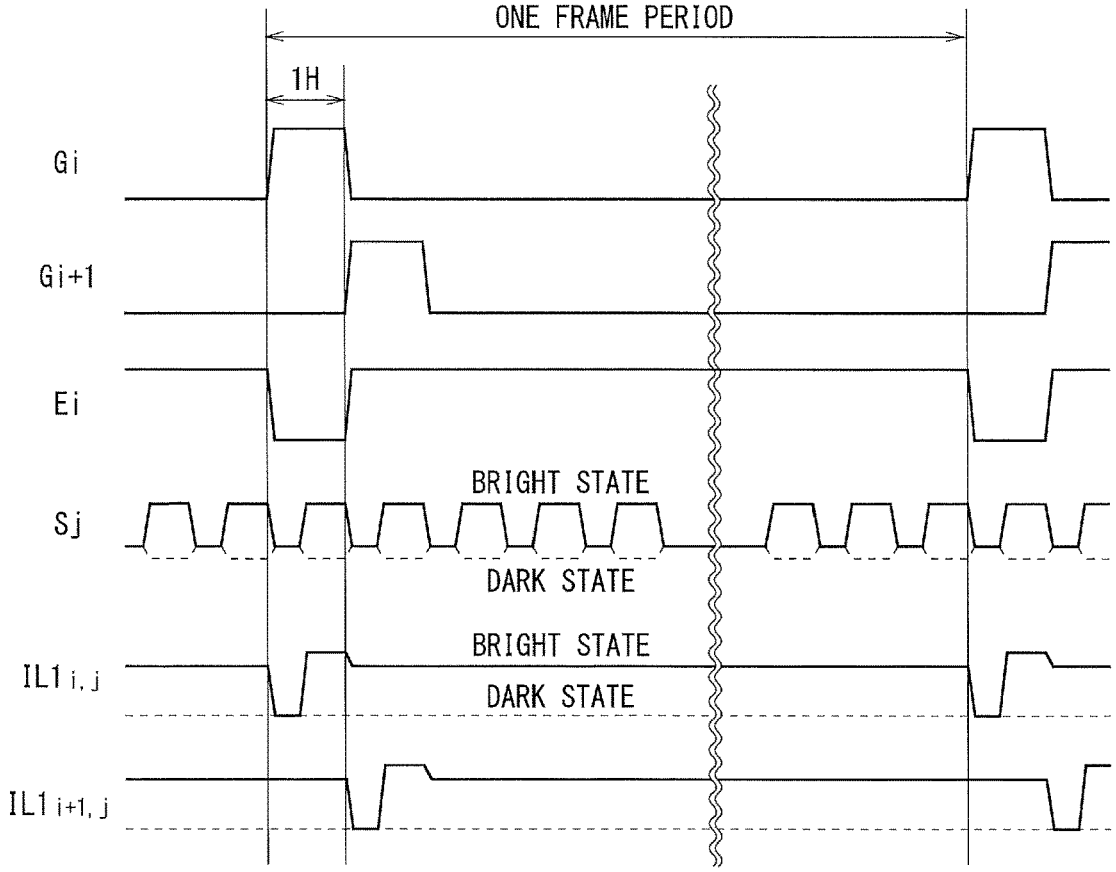
FIG. 4 is a timing chart of the pixel circuit shown in FIG. 3.

FIG. 4 is a timing chart of the pixel circuit 21. In the i-th horizontal period, the voltage of the scanning line Gi becomes the high level and a voltage of the light emission control line Ei becomes the low level. Accordingly, the TFT Q11 turns on and the TFT Q13 turns off. In a first half of the i-th horizontal period, a voltage of the data line Sj becomes a reset voltage. At this time, electric charge stored in the capacitor C1 is discharged by the reset voltage, and a gate voltage of the TFT Q12 becomes equal to the reset voltage. In a second half of the i-th horizontal period, the voltage of the data line Sj becomes a data voltage. At this time, the capacitor C1 is charged by the data voltage, and the gate voltage of the TFT Q12 becomes equal to the data voltage. If a gate-source voltage of the TFT Q12 exceeds a threshold voltage at this time, the TFT Q12 turns on, and a drive current IL1 in accordance with the gate-source voltage flows through the TFT Q12 after the TFT Q13 turns ON. The drive current IL1 flows through the TFT Q12 and the organic EL element L1, and the organic EL element L1 emits light with luminance in accordance with the drive current IL1. At an end of the i-th horizontal period, the voltage of the scanning line Gi becomes the low level and the voltage of the light emission control line Ei becomes the high level. Accordingly, the TFT Q11 turns off and the TFT Q13 turns on. After the TFT Q11 turns off, the gate-source voltage of the TFT Q12 is maintained at a level when being written, by an action of the capacitor C1. The organic EL element L1 emits light with luminance in accordance with the drive current IL1 until a next data voltage is written.

Figure 5:
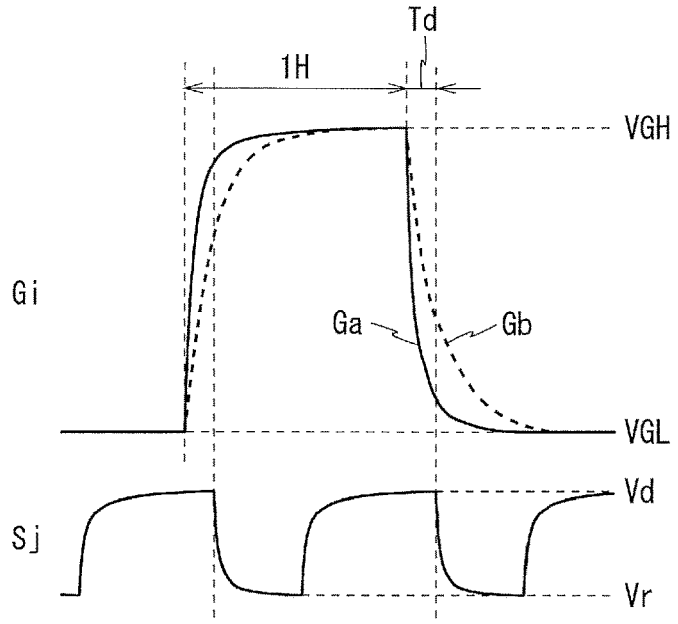
FIG. 5 is a signal waveform diagram of the pixel circuit shown in FIG. 3.

FIG. 5 is a signal waveform diagram of the pixel circuit 21. FIG. 5 describes changes in voltages of the scanning line Gi and the data line Sj. In an upper part of FIG. 5, a solid line shows the change in the voltage of the scanning line Ga, and a broken line shows the change in the voltage of the scanning line Gb. Hereinafter, it is assumed that a high-level voltage of the scanning line is VGH, a low-level voltage of the scanning line is VGL, the reset voltage is Vr, the data voltage is Vd, the gate voltage of the TFT Q12 at the end of the i-th horizontal period is Vd, and a delay time from when the voltage of the scanning line Gi starts to fall to when the voltage of the data line Sj starts to fall is Td.

At the end of the i-th horizontal period, the voltage of the scanning line Gi changes from the high level to the low level. At this time, the gate voltage of the TFT Q12 changes in accordance with a load of the scanning line Gi and the like. Since the load of the scanning line Ga is relatively small, a falling time of the voltage of the scanning line Ga is short (see solid line in upper part of FIG. 5). Thus, it is assumed that the TFT Q11 turns off before the voltage of the data line Sj starts to fail. A gate voltage V1*a* of the TFT Q12 of the pixel circuit 21 in the non-rectangular region Ra in (a+1)-th and following horizontal periods is given by a following formula (1).

$$V1a=Vd=\{C2(GH-GL)+C4(VoH-VoL)\}/(C1+C2+C3+c4) \quad (1)$$

Figure 6:
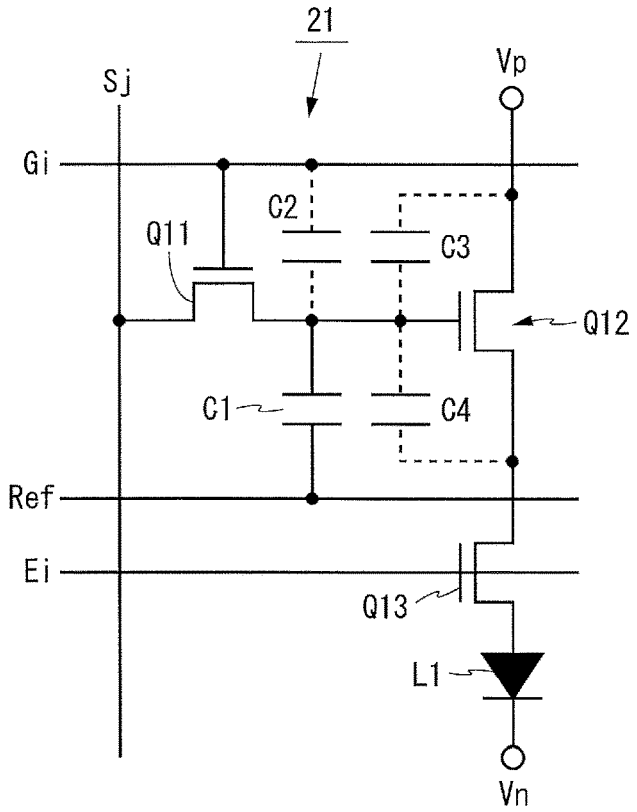
FIG. 6 is a diagram showing parasitic capacitance that occurs in the pixel circuit shown in FIG. 3.

However, in the formula (1), C1 represents a capacitance value of the capacitor C1, C2 represents a capacitance value of parasitic capacitance between the gate terminal of the TFT Q12 and the scanning line C3 represents a capacitance value of parasitic capacitance between the gate and drain of the TFT Q12, CA is a capacitance value of parasitic capacitance between the gate and source of the TFT Q12, VoH represents an anode voltage of the organic EL element L1 when the voltage of the scanning line Gi is in the high level, and VcL represents the anode voltage of the organic EL element L1 when the voltage of the scanning line Gi is in the low level (see FIG. 6).

On the other hand, since the load of the scanning line Gb is relatively large, the failing time of the voltage of the scanning line Gb is long (see broken line in upper part of FIG. 5). Thus, it is assumed that the TFT Q11 turns off after the voltage of the data line Sj starts to fall. A gate voltage V1*b* of the TFT Q12 of the pixel circuit 21 in the rectangular region in (b+1)-th and following horizontal periods satisfies a following formula (2).

$$V1b<V1a \quad (2)$$

In the pixel circuit 21, the N-channel type TFT Q12 functions as a drive transistor. Thus, the higher the gate voltage of the TFT Q12, the larger the drive current IL1, and the organic EL element L1 emits light with higher luminance. Therefore, in an organic EL display device that drives the pixel circuit 21 according to a timing shown in FIG. 4, the luminance of the non-rectangular region Ra is higher than the luminance of the rectangular region Rb (non-rectangular region Ra has high luminance).

Figure 7:
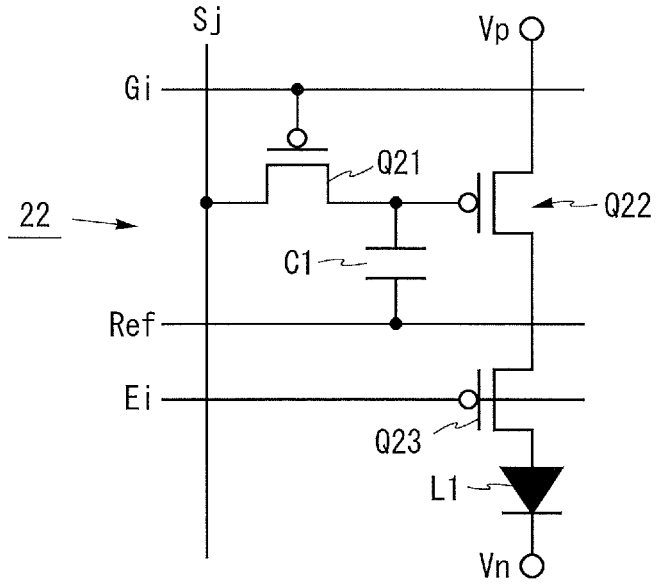
FIG. 7 is a circuit diagram of a pixel circuit according to a second example of the organic EL display device shown in FIG. 1.

FIG. 7 is a circuit diagram of a pixel circuit according to a second example. A pixel circuit 22 shown in FIG. 7 is obtained based on the pixel circuit 21 according to the first example by replacing the N-channel type TFTs Q11 to Q13 with P-channel type TFTs Q21 to Q23, respectively. A timing chart all the pixel circuit 22 is obtained based on the timing chart shown in FIG. 4 by inverting polarities of all signals.

In this case, a gate voltage V2*a* of the TFT Q22 of the pixel circuit 22 in the non-rectangular region Ra in the (a+1)-th and following horizontal periods is given by a following formula (3).

$$V2a=Vd-\{C2(GL-GH)+C4(VoL-VoH)\}/(C1+C2+C3+C4) \quad (3)$$

A gate voltage V2*b* of the TFT Q22 of the pixel circuit 22 in the rectangular region Rb in the (b+1)-th and following horizontal periods satisfies a following formula (4).

$$V2b>V2a \quad (4)$$

In the pixel circuit 22, the P-channel type TFT Q22 functions as a drive transistor. Thus, the lower the gate voltage of the TFT Q22, the larger the drive current flowing through the TFT Q22 and the organic EL element L1, and the organic EL element L1 emits light with higher luminance. Therefore, also in an organic EL display device that drives the pixel circuit 22 according to the above timing, the luminance of the non-rectangular region Ra is higher than the luminance of the rectangular region Rb (non-rectangular region Ra has high luminance).

Figure 8:
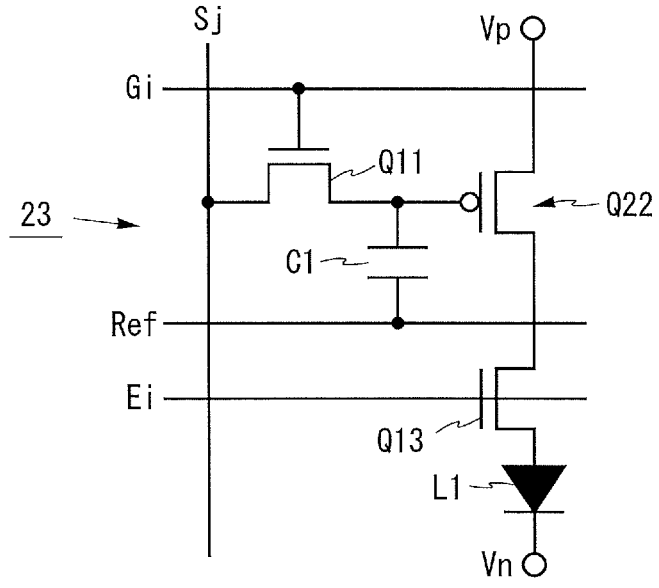
FIG. 8 is a circuit diagram of a pixel circuit according to a third example of the organic EL display device shown in FIG. 1.

FIG. 8 is a circuit diagram of a pixel circuit according to a third example. A pixel circuit 23 shown in FIG. 3 is obtained based on the pixel circuit 21 according to the first example by replacing the N-channel type TFT Q12 with the P-channel type TFT Q22. A timing chart of the pixel circuit 23 is obtained based on the timing chart shown in FIG. 4 by inverting polarities of voltages other than voltages of scanning lines Gi, Gi+1 and the light emission control line Ei. In this case, a gate voltage V3*a* of the TFT Q22 of the pixel circuit 23 in the non-rectangular region Ra in the (a+1)-th and following horizontal periods is the same as the gate voltage V1*a* shown in the formula (1). A gate voltage V3*b* of the TFT Q22 of the pixel circuit 23 in the rectangular region Rb in the (b+1)-th and following horizontal periods satisfies a following formula (5).

$$V3b>V3a \quad (5)$$

In the pixel circuit 23, the P-channel type TFT Q22 functions as a drive transistor. Thus, the lower the gate voltage of the TFT Q22, the larger the drive current flowing through the TFT Q22 and the organic EL element L1, and the organic EL element L1 emits light with higher luminance. Therefore, also in an organic EL display device that drives the pixel circuit 23 according to the above timing, the luminance of the non-rectangular region Ra is higher than the luminance of the rectangular region Rb (non-rectangular region Ra has high luminance).

Figure 9:
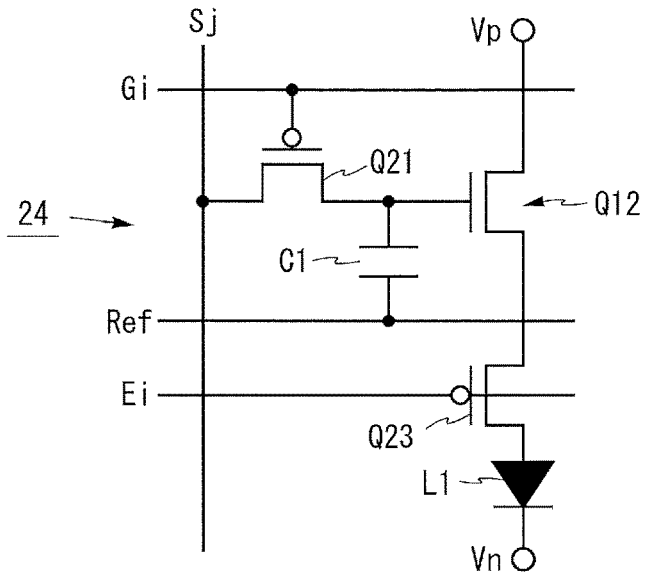
FIG. 9 is a circuit diagram of a pixel circuit according to a fourth example of the organic EL display device shown in FIG. 1.

FIG. 9 is a circuit diagram of a pixel circuit according to a fourth example. A pixel circuit 24 shown in FIG. 9 is obtained based on the pixel circuit 21 according to the first example by replacing the N-channel type TFTs Q11, Q13 with the P-channel type TFTs Q21, Q23. A timing chart of the pixel circuit 24 is obtained based on the timing chart shown in FIG. 4 by inverting polarities of the voltages of the scanning lines Gi, Gi+1 and the light emission control line Ei. In this case, a gate voltage V4*a* of the TFT Q12 of the pixel circuit 24 in the non-rectangular region Ra in the (a+1)-th and following horizontal periods is the same as the gate voltage V2*a* shown in the formula (3). A gate voltage V4*b* of the TFT Q12 of the pixel circuit 24 in the rectangular region Rb in the (b+1)-th and following horizontal periods satisfies a following formula (6).

$$V4b<V4a \quad (6)$$

In the pixel circuit 24, the N-channel type TFT Q12 functions as a drive transistor. Thus, the higher the gate voltage of the TFT Q12, the larger the drive current flowing through the TFT Q12 and the organic EL element L1, and the organic EL element L1 emits light with higher luminance. Therefore, also in an organic EL display device that drives the pixel circuit 24 according to the above timing, the luminance of the non-rectangular region Ra is higher than the luminance of the rectangular region Rb (non-rectangular region Ra has high luminance).

Note although a light emission control TFT (Q13 or Q23) is provided between the drive transistor and the organic EL element L1 in the pixel circuits according to the first to fourth examples, the light emission control TFT may be provided between the drive transistor and a node having the high-level power supply voltage Vp. Furthermore, the light emission control TFTs may be provided both between the drive transistor and the organic EL element L1 and between the drive transistor and the node having the high-level power supply voltage Vp. The light emission control TFT may be of P-channel type or of N-channel type.

Figure 10:
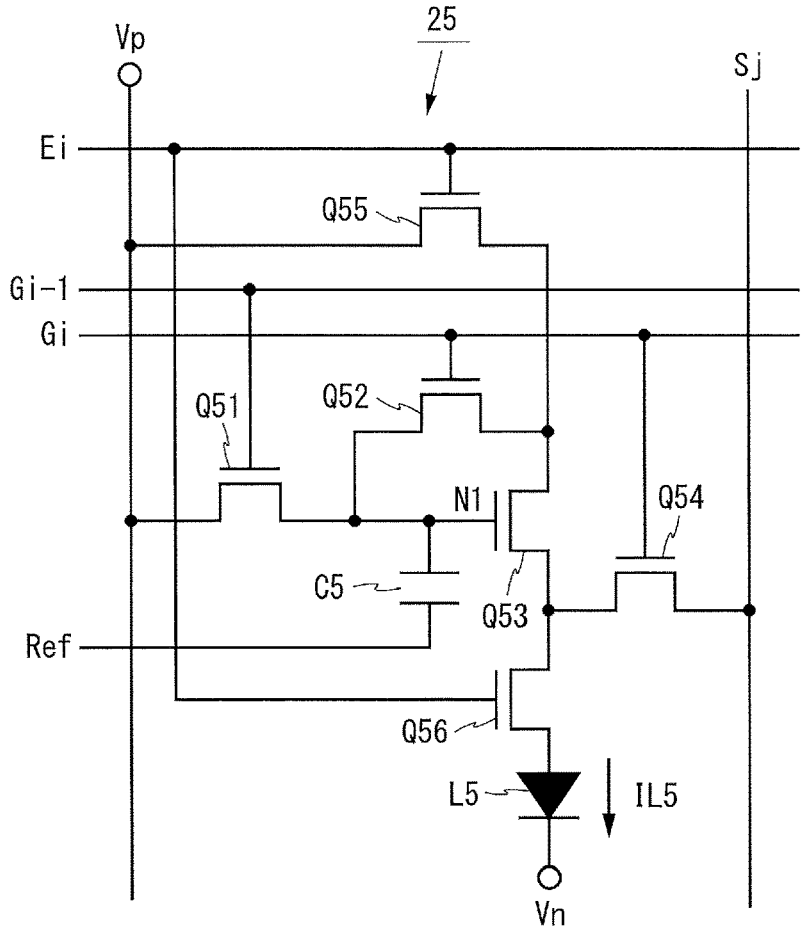
FIG. 10 is a circuit diagram of a pixel circuit according to a fifth example of the organic EL display device shown in FIG. 1.

FIG. 10 is a circuit diagram of a pixel circuit according to a fifth example. A pixel circuit 25 shown in FIG. 10 includes six N-channel type TFTs Q51 to Q56, a capacitor C5, and an organic EL element L5. The high-level power supply voltage Vp is applied to drain terminals of the TFTs Q51, Q55. A source terminal of the TFT 351 is connected to a gate terminal of the TFT Q53 and one conduction terminal (left-side terminal in FIG. 10) of the TFT Q52. A source terminal of the TFT Q55 is connected to a drain terminal of the TFT Q53 and the other conduction terminal of the TFT Q52. A source terminal of the TFT Q53 connected to one conduction terminal (left-side terminal in FIG. 10) of the TFT Q54 and a drain terminal of the TFT Q56. The other conduction terminal of the TFT Q54 is connected to the data line Sj. A source terminal of the TFT Q56 is connected to an anode terminal of the organic EL element L5, and the low-level power supply voltage Vn is applied to a cathode terminal of the organic EL element L5. A gate terminal of the TFT Q51 is connected to a scanning line Gi−1, gate terminals of the TFTs Q52, Q5 are connected to the scanning line Gi, and gate terminals of the TFTs Q55, Q56 are connected to the light emission control line Ei. The capacitor C5 is provided between the gate terminal of the TFT G53 and the reference voltage line Ref. Hereinafter, a node to which the gate of the TFT Q53 is connected is referred to as N1.

Figure 11:
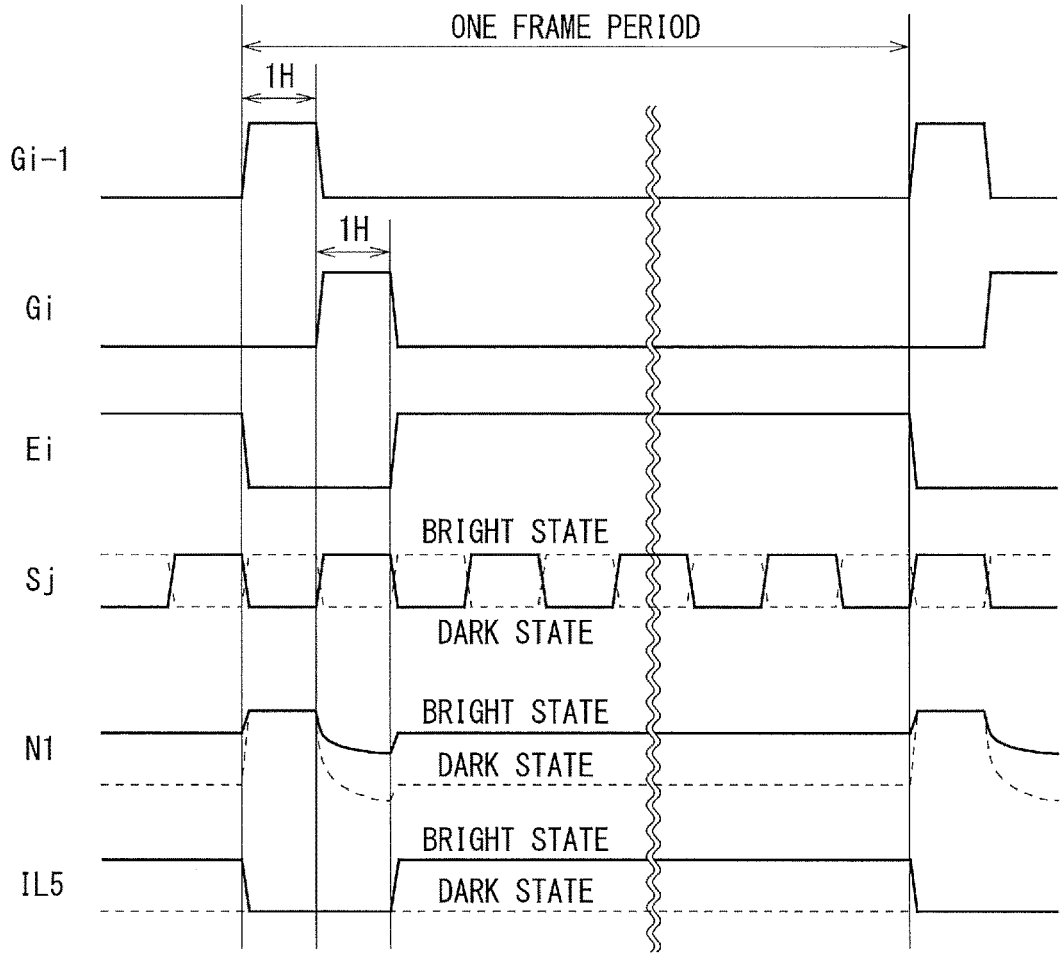
FIG. 11 is a timing chart of the pixel circuit shown in FIG. 10.

FIG. 11 is a timing chart of the pixel circuit 25. In (i−1)-th and i-th horizontal periods, the voltage of the light emission control line Ei becomes the low, level. Accordingly, the TFTs Q55, Q56 turn off. Thus, a drive current IL5 stops flowing through the organic EL element L5, and the organic EL element L5 stops light emission. In the (i−1)-th horizontal period, a voltage of the scanning line Gi−1 becomes the high level. Accordingly, the TFT Q51 turns on, and a voltage of the node N1 is initialized to Vp.

In the i-th horizontal period, the voltage of the scanning line Gi−1 becomes the low level, and the voltage of the scanning line Gi becomes the high level. Accordingly, the TFT Q51 turns off, the TFTs Q52, Q54 turn on, and the TFT Q53 is diode-connected. Furthermore, in the i-th horizontal period, the voltage of the data line Sj becomes the data voltage Vd (<Vp). Thus, the voltage of the node N1 changes from Vp to (Vd+Vth) (however, Vth is a threshold voltage of the TFT Q53).

At the end of the i-th horizontal period, the voltage of the scanning line Gi becomes the low level, and the voltage of the light emission control line Ei becomes the high level. Accordingly, the TFTs Q52, Q54 turn off, and the TFTs Q55, Q56 turn on. After the TFT Q54 turns off, a gate-source voltage of the TFT Q53 is maintained at a level when being written, by an action of the capacitor C5. Therefore, in the (i+1)-th and following horizontal periods, a drive current IL5 in accordance with the gate-source voltage of the TFT Q53 flows through the TFT Q53 and the organic EL element L5, and the organic EL element L5 emits light with luminance in accordance with the drive current IL5.

Figure 12:
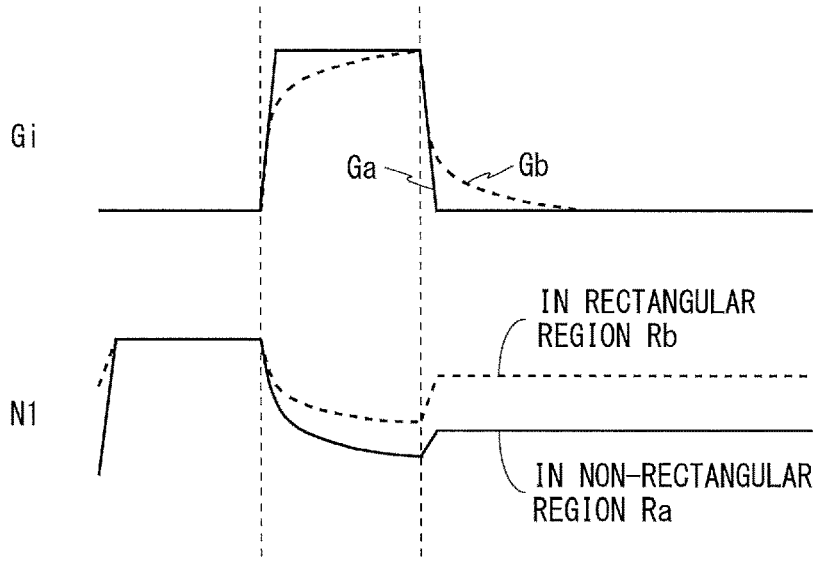
FIG. 12 is a signal waveform diagram of the pixel circuit shown in FIG. 10.

FIG. 12 is a signal waveform diagram of the pixel circuit 25. FIG. 12 describes changes in the voltages of the scanning line Gi and the data line Sj. In an upper part of FIG. 12, a solid line shows the change in the voltage of the scanning line Ga, and a broken line shows the change in the voltage of the scanning line Gb. In a lower part of FIG. 12, a solid line shows the change in the voltage of the node N1 of the pixel circuit 25 in the non-rectangular region Ra, and a broken line shows the change in the voltage of the node N1 of the pixel circuit 25 in the rectangular region Rb.

Since the load of the scanning line Ga is relatively small, the voltage of the scanning line Ga changes in a pulse manner that is close to a rectangle (see solid line in upper part of FIG. 12). Thus, at an end of the a-th horizontal period, the voltage of the node N1 of the pixel circuit 25 in the non-rectangular region Ra falls to a level close to (Vd+Vth) (see solid line in lower part of FIG. 12). On the other hand, since the load of the scanning line Gb is relatively large, the voltage of the scanning line Gb changes in a dull pulse manner (see broken line in upper part of FIG. 12). At an end of the b-th horizontal period, the voltage of the node N1 of the pixel circuit 25 in the rectangular region Rb falls only to a level higher than the voltage of the node N1 of the pixel circuit 25 in the non-rectangular region Ra (see broken line in lower part of FIG. 12).

In the pixel circuit 25, the N-channel type TFT Q53 functions as a drive transistor. Thus, the higher the voltage of the node N1, the larger the drive current IL5 flowing through the TFT Q53 and the organic EL element L5, and the organic EL element L5 emits light with higher luminance. Therefore, in an organic EL display device that drives the pixel circuit 25 according to a timing shown in FIG. 11, the luminance of the non-rectangular region Ra is lower than the luminance of the rectangular region Rb. Note that the same result is obtained by an organic EL display device having a pixel circuit in which the N-channel type TFTs Q51 to Q56 are replaced with P-channel type TFTs.

Figure 13:
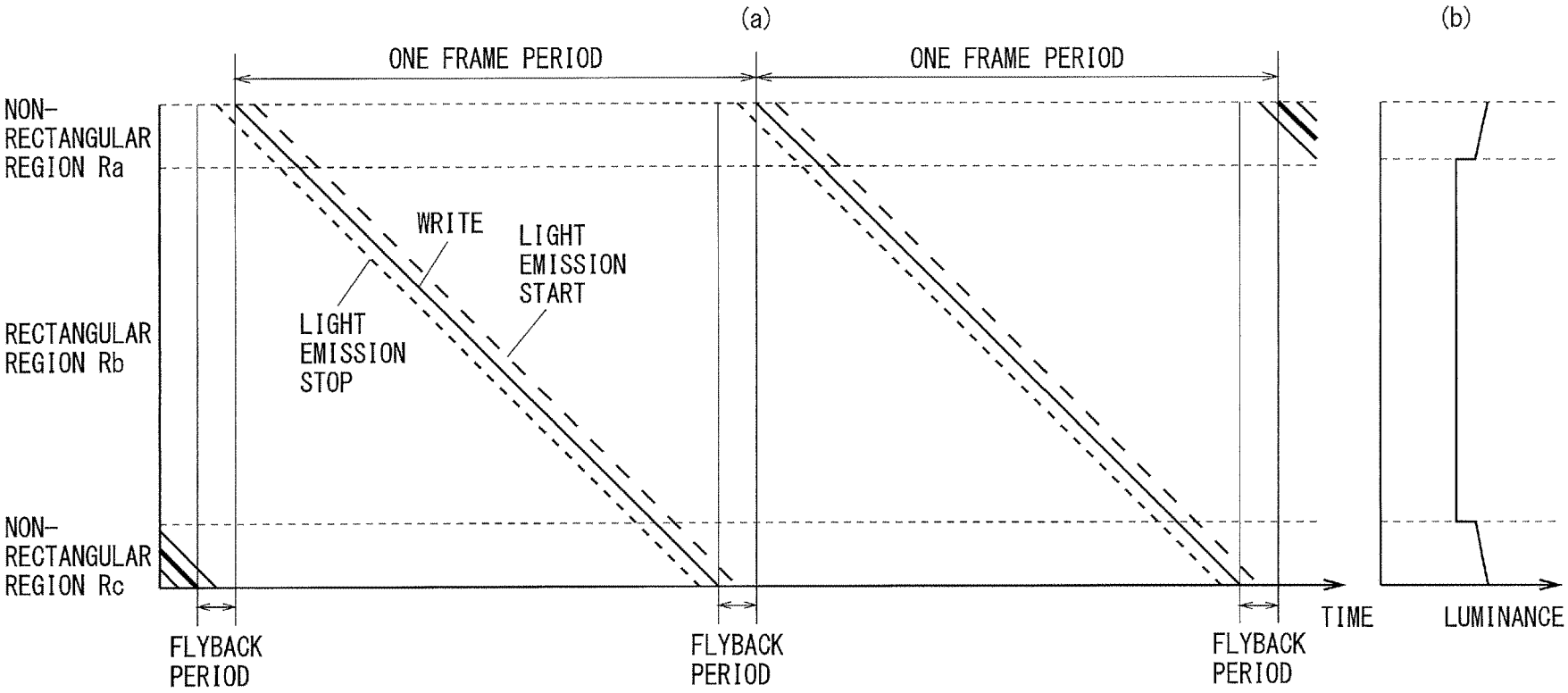
FIG. 13 is a diagram showing an operation timing and luminance of an organic EL display device according to a comparative example.
Figure 14:
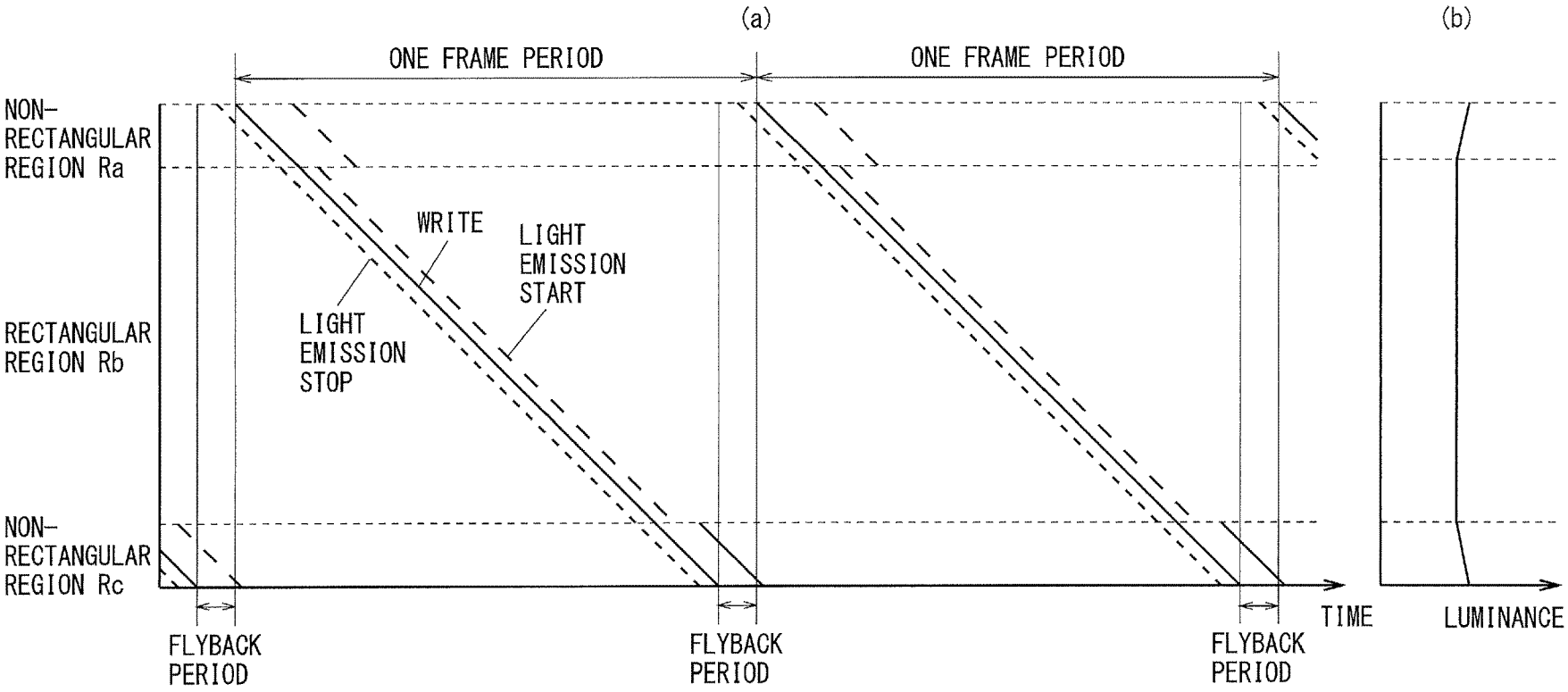
FIG. 14 is a diagram showing an operation timing and luminance of an organic EL display device according to a first example of the embodiment.
Figure 15:
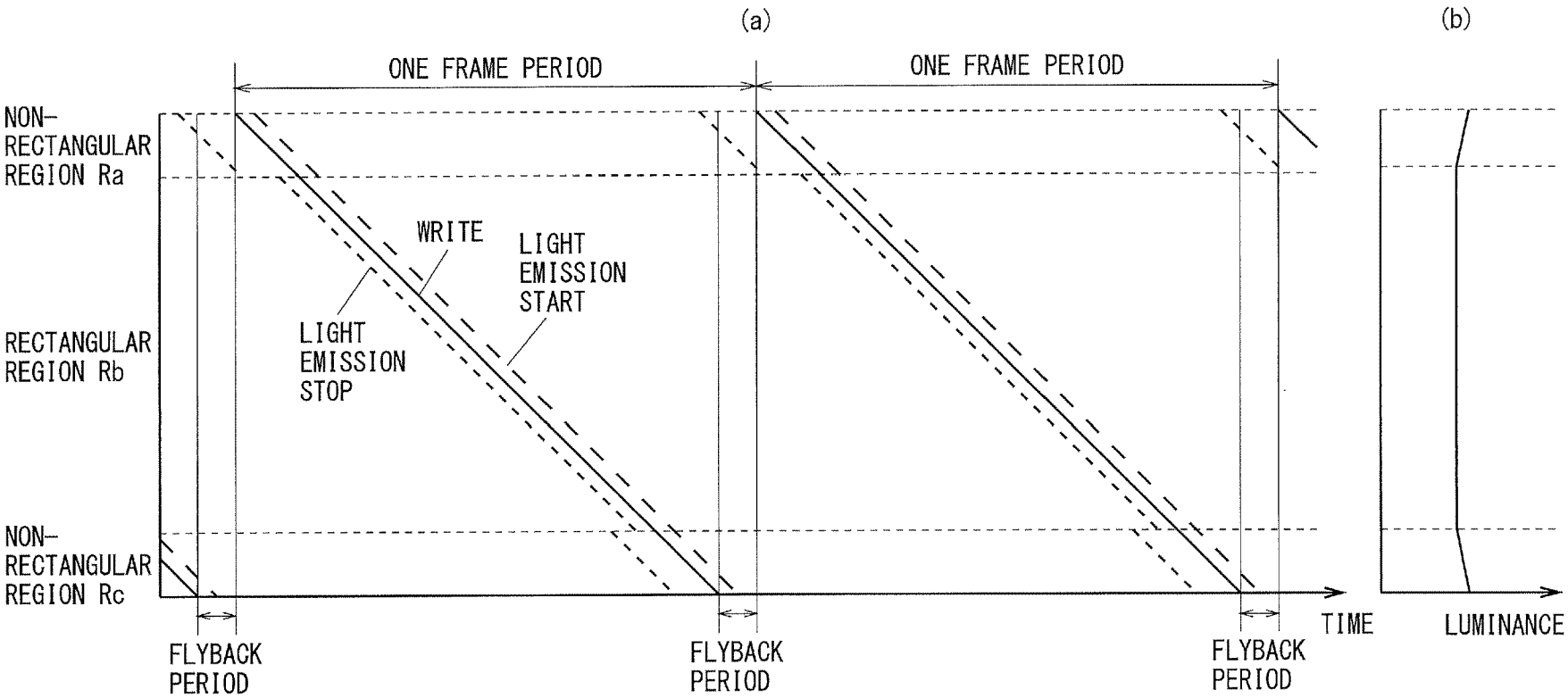
FIG. 15 is a diagram showing an operation timing and luminance of an organic EL display device according to a second example of the embodiment.

Hereinafter, with reference to FIGS. 13 to 17, the organic EL display devices 10 according to first and second examples of the present embodiment will be described. Here, as a comparative example, considered is an organic EL display device having the same organic EL panel and in which the lengths of the non-light emission periods of all the pixel circuits are same. In these organic EL display devices, one frame period is divided into m horizontal periods and a flyback period, and writing to the pixel circuits in the i-th row is performed in the i-th horizontal period. FIGS. 13 to 15 each describe an operation timing of the organic. EL display device and luminance when a same voltage is provided to all the pixel circuits.

FIG. 13 is a diagram showing the operation timing and the luminance of the organic EL display device according to the comparative example. In the organic EL display device according to the comparative example, the non-light emission period of the pixel circuits in the i-th row starts immediately before a start of the i-th horizontal period and ends immediately after the end of the i-th horizontal period. With respect to all the pixel circuits, the lengths of the non-light emission periods (length from light emission stop to light emission start) are same (see FIG. 13(*a*)).

When a same voltage is provided to all the pixel circuits, the luminance of the rectangular region Rb becomes constant, and the luminance of the non-rectangular regions Ra, Rc becomes higher as it is closer to an edge of a screen (see FIG. 13(*b*)). In the organic EL display device according to the comparative example, a large luminance difference occurs near a boundary between the non-rectangular region Ra and the rectangular region Rb and near a boundary between the rectangular region Rb and the non-rectangular region Rc, and the display quality deteriorates.

FIG. 14 is a diagram showing the operation timing and the luminance of the organic EL display device 10 according to the first example. The organic EL display device 10 according to the first example is different from the organic EL display device according to the comparative example in that the non-light emission periods of the pixel circuits 16 in the non-rectangular regions Ra, Rc end after a predetermined time from an end of a corresponding horizontal period. Thus, in the organic EL display device 10 according to the first example, the non-light emission periods of the pixel circuits 16 in the non-rectangular regions Ra, Rc are longer than the non-light emission periods of the pixel circuits 16 in the rectangular region Rb (FIG. 14(*a*)). Therefore, according to the organic EL display device 10 according to the first example, by suitably determining the length of the non-light emission periods of the pixel circuits 16 in the rectangular region Rb and the length of the non-light emission periods of the pixel circuits 16 in the non-rectangular regions Ra, Rc, the luminance difference that occurs near the boundary between the non-rectangular region Ra and the rectangular region Rb and near the boundary between the rectangular region Rb and the non-rectangular region Rc can be suppressed, and the display quality can be improved (see FIG. 14(*b*)).

FIG. 15 is a diagram showing the operation timing and the luminance of the organic EL display device 10 according to the second example. The organic EL display device 10 according to the second example is different from the organic EL display device according to the comparative example in that the non-light emission periods of the pixel circuits 16 in the non-rectangular regions Ra, Rc start before a predetermined time from a start of the corresponding horizontal period. Thus, also in the organic EL display device 10 according to the second example, as with the first example, the non-light emission periods of the pixel circuits 16 in the non-rectangular regions Ra, Rc are longer than the non-light emission periods of the pixel circuits 16 in the rectangular region Rb (see FIG. 15(*a*)). Therefore, according to the organic EL display device 10 according to the second example, as with the first example, by suitably determining the length of the non-light emission periods of the pixel circuits 16 in the rectangular region Rb and the length of the non-light emission periods of the pixel circuits 16 in the non-rectangular regions Ra, Rc, the luminance difference that occurs near the boundary between the non-rectangular region Ra and the rectangular region Rb and near the boundary between the rectangular region Rb and the non-rectangular region Rc can be suppressed, and the display quality can be improved (see FIG. 15(*b*)).

Figure 16:
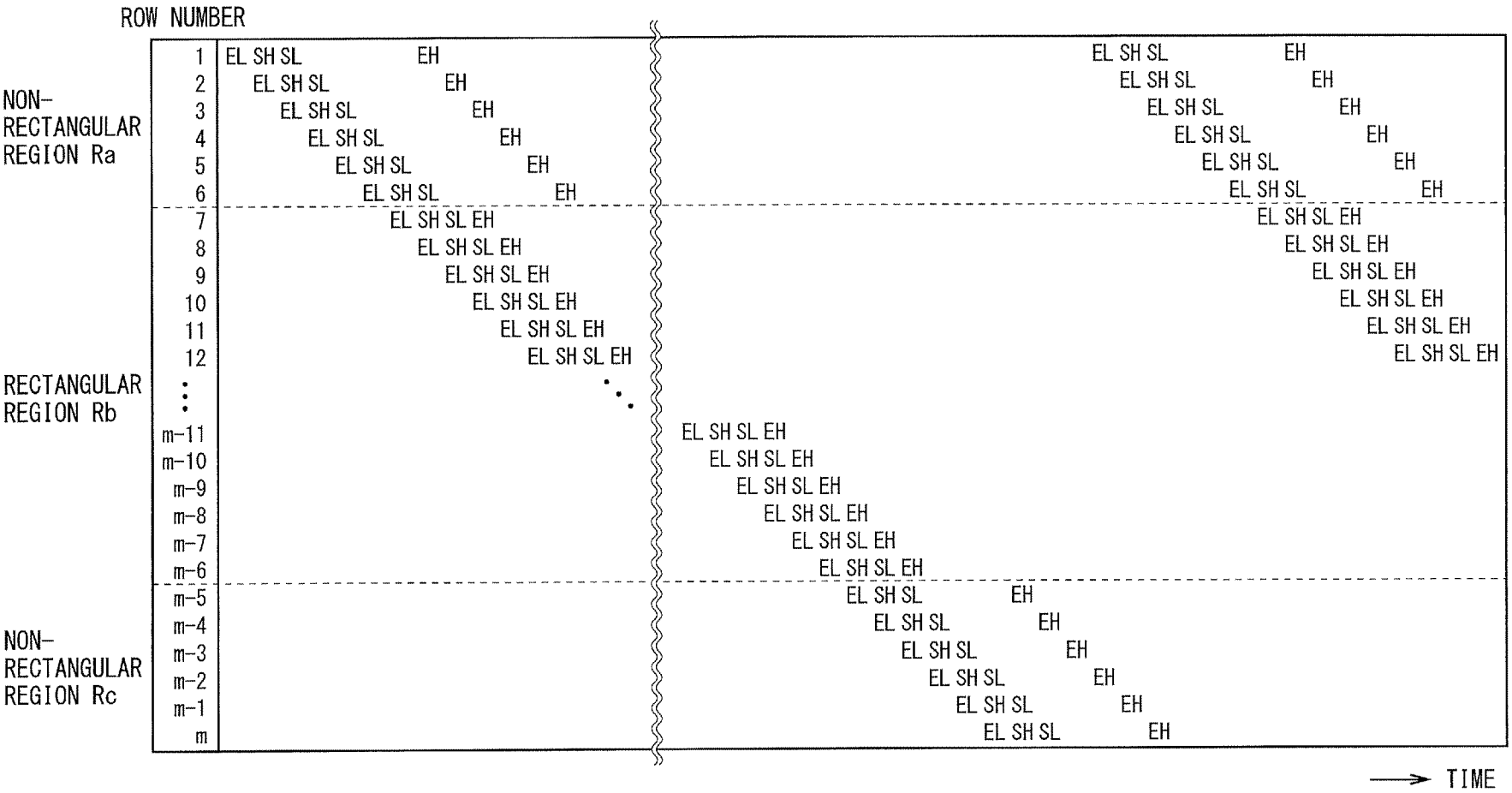
FIG. 16 is a diagram showing a part of FIG. 14 in detail.
Figure 17:
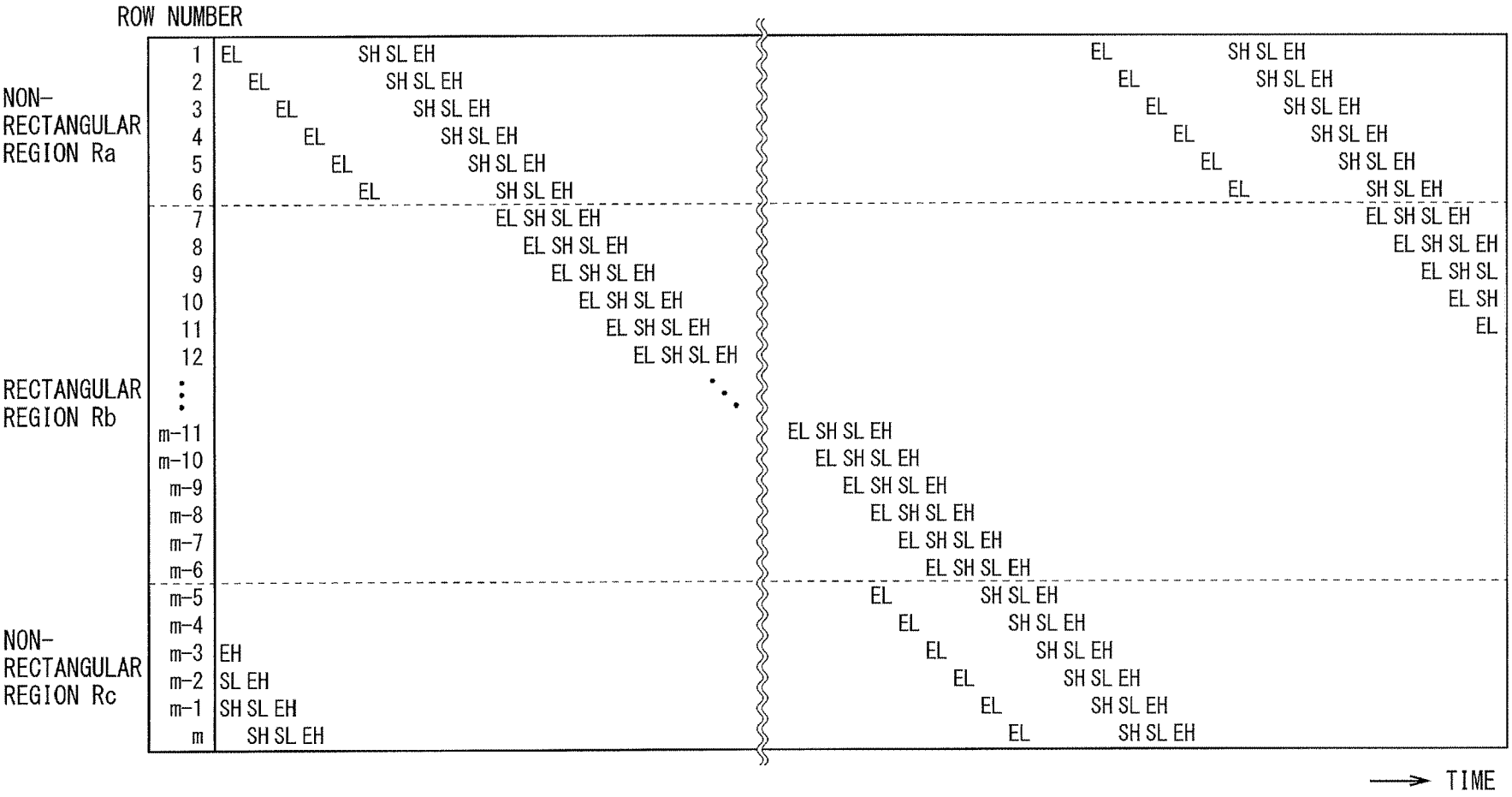
FIG. 17 is a diagram showing a part of FIG. 15 in detail.
Figure 18:
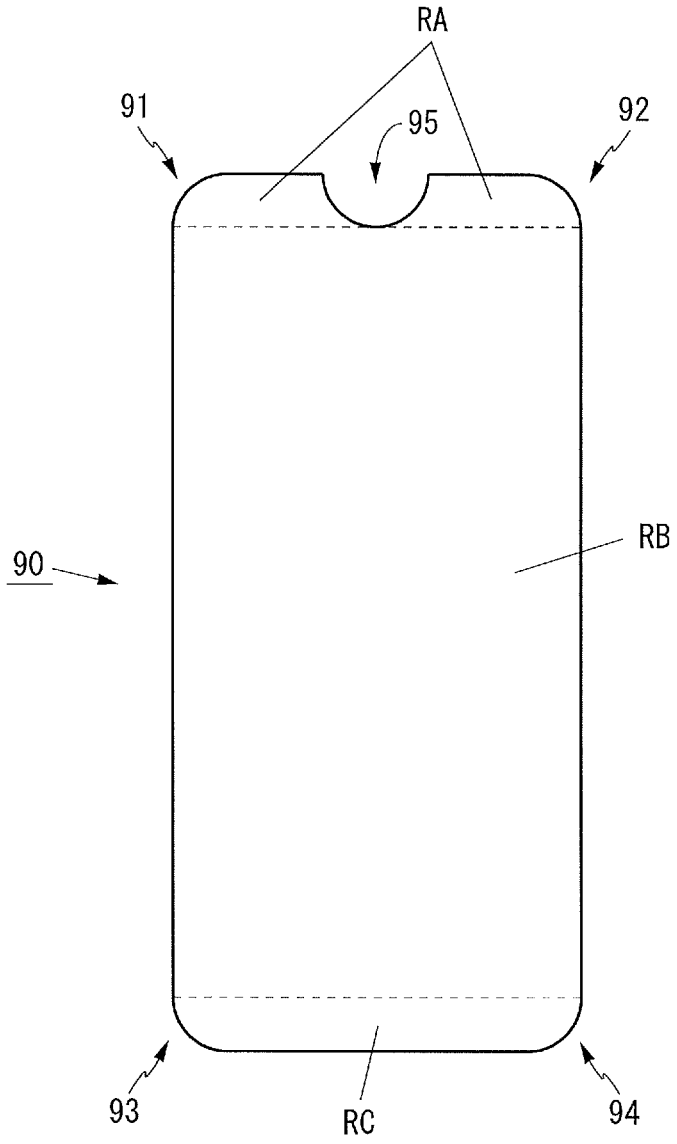
FIG. 18 is a diagram showing a non-rectangular organic EL panel.

FIG. 16 is a diagram showing a part of 14 in detail. FIG. 17 is a diagram showing a part of FIG. 15 in detail. In FIGS. 16 and 17, EL shows a light emission stop (start of non-light emission period), SH shows a start of a selection period, SL shows an end of the selection period, and EH shows a light emission start (end of non-light emission period). Here, for convenience of depicting the drawings, it is assumed that the non-rectangular region Ra includes the pixel circuits 16 in first to sixth rows, and the non-rectangular region Rc includes the pixel circuits 16 in (m−5)-th to m-th rows.

In FIG. 16, the non-light emission periods (periods from Et to EH) of the pixel circuits 16 in the rectangular region Rb start immediately before starts of the corresponding horizontal periods (periods from SH to SL), and end immediately after ends of the corresponding horizontal periods. The non-light emission periods of the pixel circuits 16 in the non-rectangular regions Ra, Rc start immediately before the start of the corresponding horizontal periods, and end after a predetermined time from the ends of the corresponding horizontal periods. In an example shown in FIG. 16, the non-light emission periods of the pixel circuits 16 in third to sixth rows end at the same timing as the non-light emission periods of the pixel circuits 16 in seventh to tenth rows, respectively.

Also in FIG. 17, as with FIG. 16, the non-light emission periods of the pixel circuits 16 in the rectangular region Rb start immediately before the starts of the corresponding horizontal periods, and end immediately after the ends of the corresponding horizontal periods. In FIG. 17, unlike FIG. 16, the non-light emission periods of the pixel circuits 16 in the non-rectangular regions Ra, Rc start before a predetermined time from the starts of the corresponding horizontal periods, and end immediately after the ends of the corresponding horizontal periods. In an example shown in FIG. 17, the non-light emission periods of the pixel circuits 16 in (m−5)-th to (m−3)-th rows start at the same timing as the non-light emission periods of the pixel circuits 16 in (m−8)-th to (m−6)-th rows, respectively.

The scanning line drive circuit 13 has a configuration in which a plurality of unit circuits is connected in multi-stage. Necessary clock signal (s) among multi-phase clock signals is/are supplied to the unit circuit in each stage of the scanning line drive circuit 13. As with the scanning line drive circuit 13, the light emission control line drive circuit 15 also has a configuration in which a plurality of unit circuits is connected in multi-stage. However, the light emission control line drive circuit 15 is designed so that lengths of periods for outputting the non-light emission level voltage differ accordance with regions.

As described above, a display device (organic EL display device 10) according to the embodiment includes a non-rectangular display panel (organic EL panel 11) having a plurality of scanning lines G1 to Gm, a plurality of data lines S1 to Sn, a plurality of light emission control lines E1 to Em extending in the same direction as the scanning lines G1 to Gm, and a plurality of pixel circuits 16, the scanning line drive circuit 13 that drives the scanning lines G1 to Gm to select the pixel circuits 16 in units of row, the data line drive circuit 14 that drives the data lines S1 to Sn, and the light emission control line drive circuit 15 that drives the light emission control lines E1 to Em to control the pixel circuits 16 to the light emission state and the non-light emission state in units of row. When the display panel is divided into the rectangular region Rb and the non-rectangular regions Ra, Rc by boundary lines (broken lines shown in FIG. 1) extending in the same direction as the scanning Lines G1 to Gm, the light emission control line drive circuit 15 drives the light emission control lines E1 to Em so that a length of a first non-light emission period in which the pixel circuits 16 in each row in the rectangular region Rb are in the non-light emission state and a length of a second non-light emission period in which the pixel circuits 16 in each row in the non-rectangular regions Ra, Rc are in the non-light emission state are different.

According to such a display device, by suitably setting the length of the first non-light emission period (non-light emission period of the pixel circuits 16 in each row in the rectangular region Rb) and the length of the second non-light emission period (non-light emission period of the pixel circuits 16 in each row in the non-rectangular regions Ra, Rc), the luminance difference that occurs near the boundary between the rectangular region Rb and the non-rectangular regions Ra, Rc can be suppressed, and the display quality can be improved.

In the display device, when a period from a start of the first non-light emission period of the pixel circuit 16 in the rectangular region Rb to an end of the selection period of the same pixel circuit 16 is a first period, a period from a start of the second non-light emission period of the pixel circuit 16 in the non-rectangular regions Ra, Rc to an end of the selection period of the same pixel circuit 16 is a second period, a period from the end of the selection period of the pixel circuit 16 in the rectangular region Rb to an end of the first non-light emission period of the same pixel circuit 16 is a third period, and a period from the end of the selection period of the pixel circuit 16 in the non-rectangular regions Ra, Rc to an end of the second non-light emission period of the same pixel circuit 16 is a fourth period, the first period and the second period may have different lengths, the third period and the fourth period may have different lengths, or the first period and the second period may have different lengths and the third period and the fourth period may have different lengths. With this, by driving the light emission control lines E1 to Em so that the length of the first non-light emission period and the length of the second non-light emission period are different, the luminance difference that occurs near the boundary between the rectangular region Rb and the non-rectangular regions Ra, Rc can be suppressed, and the display quality can be improved.

When a same voltage is provided to the pixel circuits 16 and the lengths of the non-light emission periods of the pixel circuits 16 are set to be same, in a case where the luminance of the non-rectangular regions Ra, Rc is higher than the luminance of the rectangular region Rb (when the non-rectangular region has high luminance), it is enough to make second non-light emission period be longer than the first non-light emission period (case of $p>g$ and $g<r$ in FIG. 2, FIGS. 14 and 15). For this, the first period and the second period may have a same length, and the fourth period may be longer than the third period (FIG. 15). Or, the second period may be longer than the first period, and the third period and the fourth period may have a same length 16). With this, when the non-rectangular region has high luminance, by setting the second non-light emission period longer than the first non-light emission period, the luminance difference that occurs near the boundary between the rectangular region Rb and the non-rectangular regions Ra, Rc can be suppressed, and the display quality can be improved.

Contrary to this, when a same voltage is provided to the pixel circuits 16 and the lengths of the non-light emission periods of the pixel circuits 16 are set to be same, in a case where the luminance of the non-rectangular regions Ra, Rc is lower than the luminance of the rectangular region Rb (when the non-rectangular region has low luminance), it is enough to make the second non-light emission period be shorter than the first non-light emission period (case of $p<q$ and $q>r$ in FIG. 2). For this, the second period may be shorter than the first period, and the third period and the fourth period may have a same length. Or, the first period and the second period may have a same length, and the fourth period may be shorter than the third period. With this, when the non-rectangular region has low luminance, by setting the second non-light emission period shorter than the first non-light emission period, the luminance difference that occurs near the boundary between the rectangular region Rb and the non-rectangular regions Ra, Rc can be suppressed, and the display quality can be improved. Furthermore, when the first period and the second period have the same length, or when the third period and the fourth period have the same length, the light emission control line drive circuit 15 can be configured easily.

With respect to the pixel circuits 16 in at least one row in the rectangular region Rb and the pixel circuits 16 in at least one row in the non-rectangular regions Ra, Rc, the first non-light emission period and the second non-light emission period may end at a same timing (FIG. 14). Or, with respect to the pixel circuits 16 in at least one row in the rectangular region Rb and the pixel circuits 16 in at least one row in the non-rectangular regions Ra, Rc, the first non-light emission period and the second non-light emission period may start at a same timing (FIG. 15). With this, by driving the light emission control lines E1 to Em so that the length of the first non-light emission period and the length of the second non-light emission period are different, the luminance difference that occurs near the boundary between the rectangular region Rb and the non-rectangular regions Ra, Rc can be suppressed, and the display quality can be improved.

With respect to the pixel circuits 16 in each row in the non-rectangular regions Ra, Rc, the lengths of the second non-light emission periods may be same (case of p=r in FIG. 2, FIGS. 14 and 15). With respect to the pixel circuits 16 in each row in the rectangular region Rb, the lengths of the first non-light emission periods may be same (FIGS. 2, 14 and 15). With this, the light emission control line drive circuit 15 can be configured easily.

Although as an example of a display device having a non-rectangular display panel, the organic EL display device having a pixel circuit including an organic EL element (organic light emitting diode) has been described so far, an inorganic EL display device having a pixel circuit including an inorganic light emitting diode or a QLED (Quantum-dot Light Emitting Diode) display device having a pixel circuit including a quantum dot light emitting diode may be configured by a similar method.

DESCRIPTION OF REFERENCE CHARACTERS

1 to 4: ROUND CORNER
5: NOTCH
10: ORGANIC EL DISPLAY DEVICE
11: ORGANIC EL PANEL
12: DISPLAY CONTROL CIRCUIT
13: SCANNING LINE DRIVE CIRCUIT
14: DATA LINE DRIVE CIRCUIT
15: LIGHT EMISSION CONTROL LINE DRIVE CIRCUIT
16, 21 to 25: PIXEL CIRCUIT

The invention claimed is:

1. A display device comprising:

a non-rectangular display panel including a plurality of scanning lines, a plurality of data lines, a plurality of light emission control lines extending in a same direction as the scanning lines, and a plurality of pixel circuits;

a scanning line drive circuit configured to drive the scanning lines to select the pixel circuits in units of row;

a data line drive circuit configured to drive the data lines; and a light emission control line drive circuit configured to drive the light emission control lines to control the pixel circuits to a light emission state and a non-light emission state in units of row, wherein when the display panel is divided into a rectangular region and a non-rectangular region by a boundary line extending in the same direction as the scanning lines, the light emission control line drive circuit is configured to drive the light emission control lines so that a length of a first non-light emission period in which the pixel circuits in each row in the rectangular region are in the non-light emission state and a length of a second non-light emission period in which the pixel circuits in each row in the non-rectangular region are in the non-light emission state are different.

2. The display device according to claim 1, wherein the second non-light emission period is longer than the first non-light emission period.

3. The display device according to claim 1, wherein the second non-light emission period is shorter than the first non-light emission period.

4. The display device according to claim 1, wherein when a period from a start of the first non-light emission period of the pixel circuit in the rectangular region to an end of a selection period of the same pixel circuit is a first period, a period from a start of the second non-light emission period of the pixel circuit in the non-rectangular region to an end of the selection period of the same pixel circuit is a second period, a period from the end of the selection period of the pixel circuit in the rectangular region to an end of the first non-light emission period of the same pixel circuit is a third period, and a period from the end of the selection period of the pixel circuit in the non-rectangular region to an end of the second non-light emission period of the same pixel circuit is a fourth period, the first period and the second period have different lengths, the third period and the fourth period have different lengths, or the first period and the second period have different lengths and the third period and the fourth period have different lengths.

5. The display device according to claim 4, wherein the first period and the second period have a same length, and the fourth period is longer than the third period.

6. The display device according to claim 4, wherein the second period is longer than the first period, and the third period and the fourth period have a same length.

7. The display device according to claim 4, wherein the first period and the second period have a same length, and the fourth period is shorter than the third period.

8. The display device according to claim 4, wherein the second period is shorter than the first period, and the third period and the fourth period have a same length.

9. The display device according to claim 2, wherein when a same voltage is provided to the pixel circuits and lengths of non-light emission periods of the pixel circuits are set to be same, luminance of the non-rectangular region is higher than the luminance of the rectangular region.

10. The display device according to claim 3, wherein when a same voltage is provided to the pixel circuits and lengths of non-light emission periods of the pixel circuits are set to be same, luminance of the non-rectangular region is lower than the luminance of the rectangular region.

11. The display device according to claim 1, wherein with respect to the pixel circuits in at least one row in the rectangular region and the pixel circuits in at least one row in the non-rectangular region, the first non-light emission period and the second non-light emission period end at a same timing.

12. The display device according to claim 1, wherein with respect to the pixel circuits in at least one row in the rectangular region and the pixel circuits in at least one row in the non-rectangular region, the first non-light emission period and the second non-light emission period start at a same timing.

13. The display device according to claim 1, wherein with respect to the pixel circuits in each row in the non-rectangular region, the lengths of the second non-light emission periods are same.

14. The display device according to claim 13, wherein with respect to the pixel circuits in each row in the rectangular region, the lengths of the first non-light emission periods are same.

15. A method for driving a display device having a non-rectangular display panel including a plurality of scanning lines, a plurality of data lines, a plurality of light emission control lines extending in a same direction as the scanning lines, and a plurality of pixel circuits, the method comprising:

driving the scanning lines to select the pixel circuits in units of row;

driving the data lines; and driving the light emission control lines to control the pixel circuits to a light emission state and a non-light emission state in units of row, wherein when the display panel is divided into a rectangular region and a non-rectangular region by a boundary line extending in the same direction as the scanning lines, in driving the light emission control lines, the light emission control lines are driven so that a length of a first non-light emission period in which the pixel circuits in each row in the rectangular region are in the non-light emission state and a length of a second non-light emission period in which the pixel circuits in each row in the non-rectangular region are in the non-light emission state are different.

* * * * *